US007654833B2

(12) United States Patent
Fork et al.

(10) Patent No.: US 7,654,833 B2
(45) Date of Patent: Feb. 2, 2010

(54) BRITTLE FRACTURE RESISTANT SPRING

(75) Inventors: David K. Fork, Los Altos, CA (US); Thomas Hantschel, Wevelgem (BE)

(73) Assignee: Palo Alto Research Center Incorporated, Palo Alto, CA (US)

( * ) Notice: Subject to any disclaimer, the term of this patent is extended or adjusted under 35 U.S.C. 154(b) by 314 days.

(21) Appl. No.: 11/851,479

(22) Filed: Sep. 7, 2007

(65) Prior Publication Data

US 2007/0296129 A1 Dec. 27, 2007

Related U.S. Application Data

(62) Division of application No. 11/347,740, filed on Feb. 2, 2006, now Pat. No. 7,278,857.

(51) Int. Cl.
*H01R 12/00* (2006.01)

(52) U.S. Cl. ..... 439/81; 439/66; 29/874

(58) Field of Classification Search ..... 439/81, 439/66; 29/874, 843; 267/182; 438/117, 438/106

See application file for complete search history.

(56) References Cited

U.S. PATENT DOCUMENTS

| | | | | |
|---|---|---|---|---|
| 5,613,861 | A | 3/1997 | Smith et al. | |
| 6,528,350 | B2 | 3/2003 | Fork | |
| 6,827,584 | B2 * | 12/2004 | Mathieu et al. | 439/66 |
| 6,973,722 | B2 * | 12/2005 | Hantschel et al. | 29/874 |
| 7,048,548 | B2 | 5/2006 | Mathieu et al. | |
| 2006/0030179 | A1 | 2/2006 | Van Schuylenbergh et al. | |

* cited by examiner

*Primary Examiner*—Michael C Zarroli
(74) *Attorney, Agent, or Firm*—Marger Johnson & McCollom, P.C.

(57) ABSTRACT

A spring contact has a post-release outer upper surface in compression and a post-release outer lower surface in compression. A compressive lower layer of spring material may be formed at a thickness that is three-eighths or less of a tensile upper layer of spring material. A low modulus of elasticity cladding material may also be applied to the outer surface of the spring contact with a lower surface of the cladding material being formed with a compressive stress.

5 Claims, 4 Drawing Sheets

BRITTLE FRACTURE RESISTANT SPRING

This application is a divisional of and claims priority to application Ser. No. 11/347,740 filed Feb. 2, 2006.

GOVERNMENT FUNDING

This invention was made with Government support under 70NANB8H4008 awarded by the National Institute of Standards and Technology (NIST). The Government has certain rights in this invention.

TECHNICAL FIELD

This disclosure relates to conductive spring contacts and more particularly to stress engineered spring contacts.

BACKGROUND

Metal spring contacts are used for electrically connecting integrated circuit chips or dies to circuit boards or other devices and may also be used as probe needles on a probe card. Spring contacts allow for reduced pitch, and thus, for smaller devices.

Spring contacts may be formed by depositing a release layer of material and then depositing at least two layers of stress engineered spring metal. The spring metal may be a molybdenum-chrome alloy or a nickel-zirconium alloy, as examples. The spring metal is patterned to form spring contacts and the release layer is patterned to release a free end of the spring contact. In reaction to the stresses engineered into the spring metal, the free end of the spring contact curls up. To increase the conductive and spring qualities of the spring contact, the contact may then be cladded or overplated with another material.

Each layer of spring metal has a stress introduced into it. The stress introduction may be accomplished in variety of ways during a sputter depositing of the spring metal, including adding a reactive gas to the plasma, depositing the metal at an angle and changing the pressure of the plasma gas. A compressive or a tensile stress is introduced into each layer.

Spring metals are typically brittle, particularly those that retain large stresses such as those used to make spring contacts. According to Griffith crack theory, under compression, brittle materials are strong, but under tension, cracks readily develop and propagate. For spring contacts, during spring release, if the materials are too brittle, the springs will break off in solution, leaving behind micro-machined shrapnel in the release etch. This is particularly problematic when surface flaws are present. Film brittleness has been seen to a greater degree as the spring formation process is scaled up to mass production.

The engineered stress through the thickness of two layers of deposited spring metal is shown in FIG. 1. Here the spring has a total thickness of 1 micron and a +/−1 Giga Pascal (GPa) stress variation. Stated another way, this is a 1 micron spring with a stress variation ($\Delta\sigma$) of 2 GPa. The stress in the layers prior to spring release is indicated by the thick solid line, and the stress profile through the thickness is indicated by the thin solid line. A dashed vertical line indicates the position within the film thickness of the neutral axes, i.e. the point inside the spring that has no change in strain before and after release.

After release, the bottom surface of the spring is placed under tension while the top surface is placed under compression. The tensile loading of the bottom surface may promote crack propagation.

SUMMARY OF THE DISCLOSURE

A brittle fracture resistant spring contact has a post-release upper surface in compression and a post-release lower surface in compression. The spring contact may be formed by depositing a compressive lower layer of spring metal that is one-third thinner or less than a deposited tensile upper layer of spring metal.

A crack resistant spring contact may also include low modulus of elasticity cladding applied to the outer surface of the spring with the bottom layer of cladding being applied with a compressive stress.

DETAILED DESCRIPTION

Solutions to the brittleness of spring contact material may lie in several areas including composition of the alloy, improved sputter process conditions and more robust spring design. Prevention of the creation and propagation of brittle cracking may be achieved by providing a compressive outer surface to the spring material after the spring is released.

Figure 1:
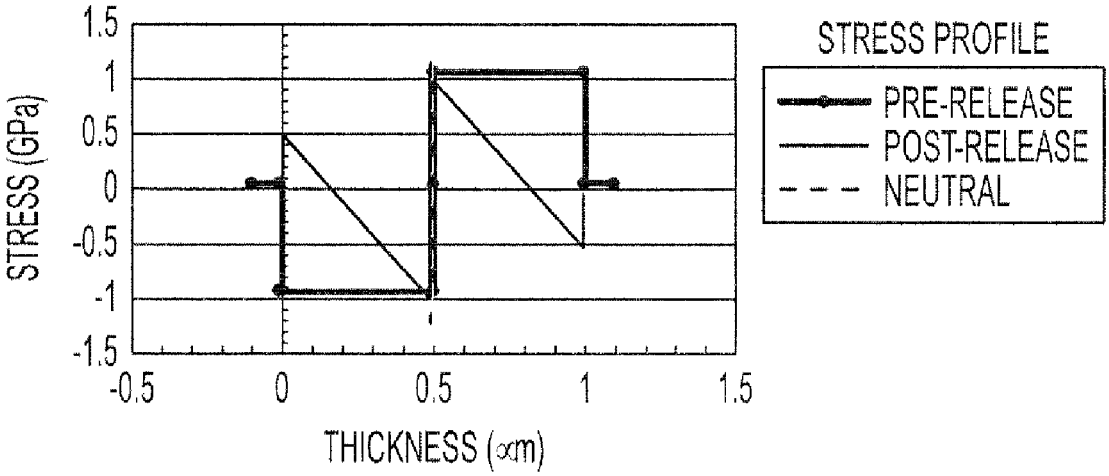
FIG. 1 is a graph showing a stress profile through a thickness of a present spring contact before and after release of the spring contact.
Figure 2:
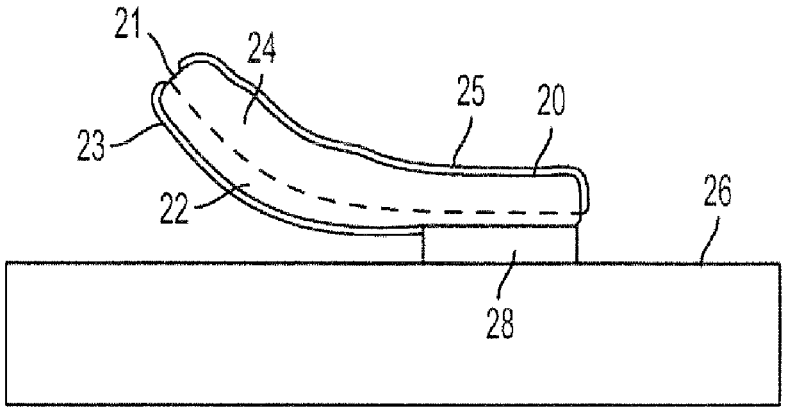
FIG. 2 is a side elevation view of a spring contact after release.
Figure 3:
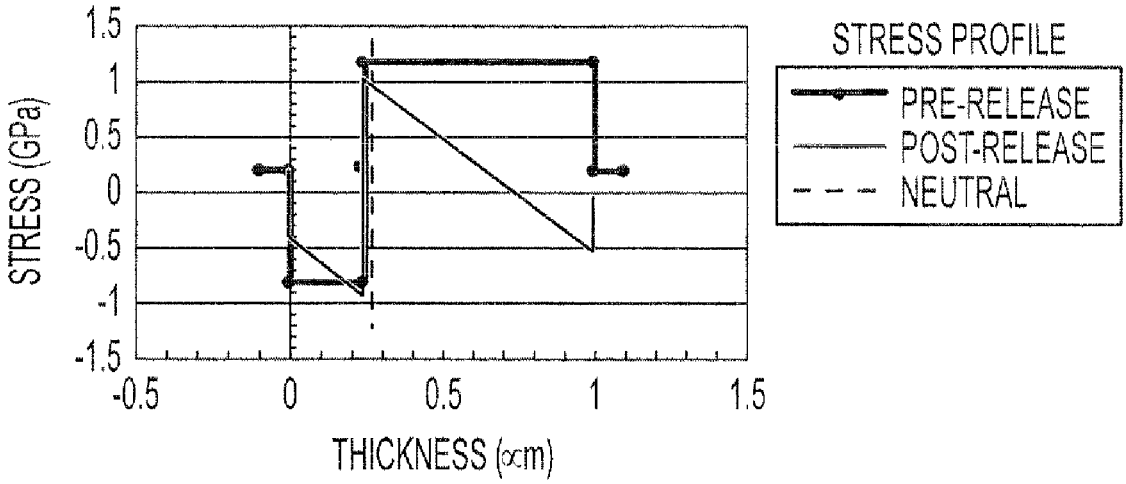
FIG. 3 is a graph showing a stress profile through a thickness of a bi-layer spring contact before and after release of the spring contact.

FIG. 2 is a side elevation view of a released spring contact 20 comprised of a lower layer of spring material 22 and an upper layer of spring material 24 anchored to substrate 26 by anchor point 28. FIG. 3 is a graph showing a stress profile through a thickness of a bi-layer spring contact 20 before and after release of the spring contact which is a 1 micron, $\Delta\sigma 2$ GPa spring. The stress prior to release is indicated by the thick solid line and the stress profile after release is indicated by the thin solid line. The dashed vertical line indicates the position of the neutral axes within the film thickness where there is no change in strain before and after release.

The lower layer 22 is deposited with a compressive stress introduced and the upper layer 24 is deposited with a tensile stress introduced. The spring material may be a molybdenum-chrome alloy or a nickel-zirconium alloy, as examples. The compressive lower layer 22 is ⅓ the thickness of the tensile upper layer 24. After the spring is released, the bottom surface of the lower layer 22 remains compressive. The neutral axis 21 is shifted from the halfway point in the thickness closer to the bottom surface at the interface between the upper and lower layers 22, 24.

Because the bottom surface remains compressive, a Griffith surface flaw must be subjected to a significant tensile load before the crack can propagate. In this state, the breaking strength becomes the normal breaking strength plus the magnitude of the compressive surface residual stress. Thus, the chance of spring breakage is minimized.

Figure 4:
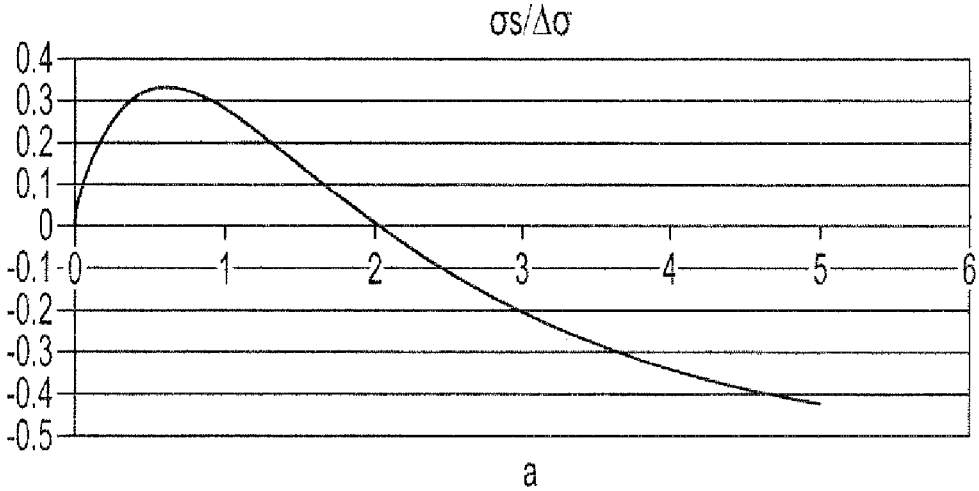
FIG. 4 is a graph showing a normalized bottom surface stress versus a thickness ratio for a bi-layer spring contact.

The general expression for the bottom surface stress σs after release for a two layer spring is:

$$\sigma_s/\Delta\sigma = a(2-a)/(1+a)^2;$$

$$a = h_2/h_1,$$

where h1 and h2 are the bottom and top layer thicknesses, respectively. A plot of this function is shown in FIG. 4, which is a graph showing a normalized bottom surface stress versus a thickness ratio for a bi-layer spring contact. As long as h1<h2/2, or in other words, thickness h1 is one half or less than thickness h2, the surface stress on the bottom layer will remain compressive throughout the transition from the as-grown state through to the fully released state. When h1=2h2, the tensile load on the bottom surface is maximized, which is the most undesirable condition, and the condition at h1=h2 is not much better.

When the compressive lower layer is made thinner, the net stress of the spring as it is deposited on the substrate is no longer zero. Tensile stress is generally more problematic than compressive stress because it may lead to cracking in the unreleased state. To overcome any potential problems presented by the net tensile stress, the compressive stress in the lower layer may be made larger than the tensile stress in the upper layer.

Figure 5:
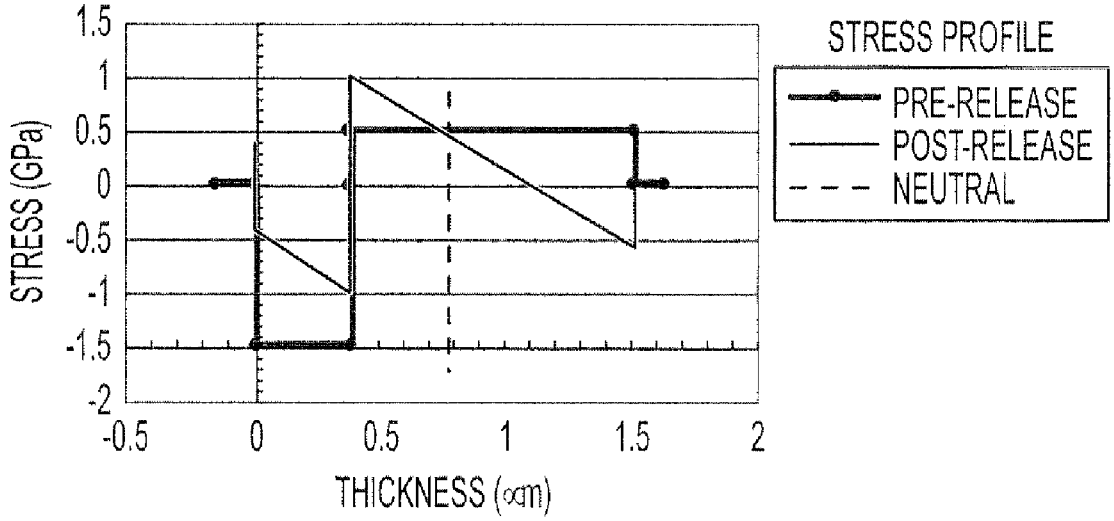
FIG. 5 is a graph showing a stress profile through a thickness of another bi-layer spring contact before and after release of the spring contact.

FIG. 5 is a graph showing the stress profile through a thickness of another bi-layer spring contact where the pre-release compressive stress is shown to be three times larger than the tensile stress and the compressive lower layer is one-third the thickness of the tensile upper layer. This design produces an unreleased spring with zero net stress.

Multiple layers of spring material may also be deposited to create a spring contact. In this case, a bottom layer of spring metal is deposited and a compressive stress is introduced into that layer. Intermediate layers of spring metal are then deposited with compressive and tensile stresses introduced into those layers culminating with the top layer of spring metal deposited and a tensile stress introduced into that layer.

Figure 6:
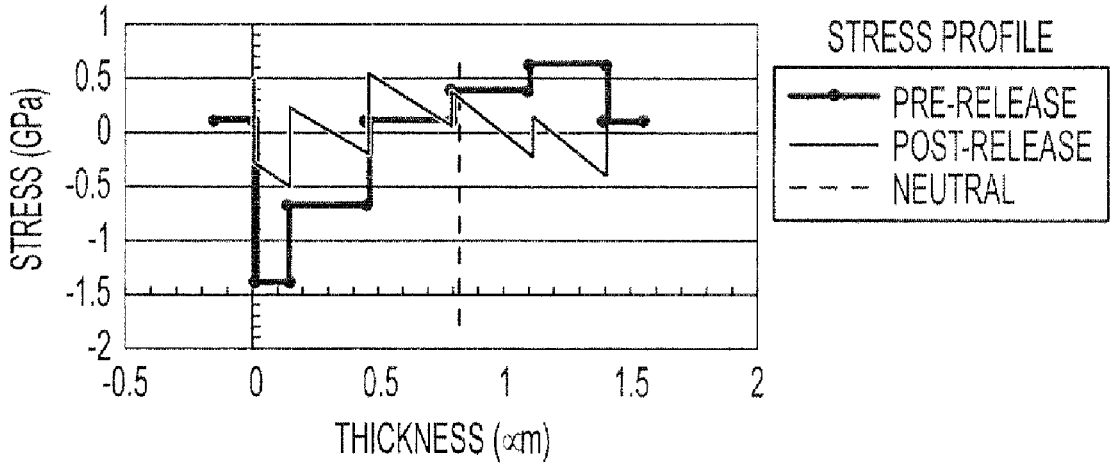
FIG. 6 is a graph showing a stress profile through a thickness of a multi-layer spring contact before and after release of the spring contact.

FIG. 6 is a graph showing the stress profile through a thickness of a five layer spring contact. By utilizing more than two layers of spring material during the formation of the spring, the magnitude of the transitions from compressive to tensile stress within the thickness post-release are decreased. To keep the bottom surface in compression post-release, the lowest layer is made twice as thin as the rest of the layers in the structure. Further, the magnitude of the introduced stress in the rest of the layers may be made less than the magnitude of the compressive stress introduced into the bottom layer.

Figure 7:
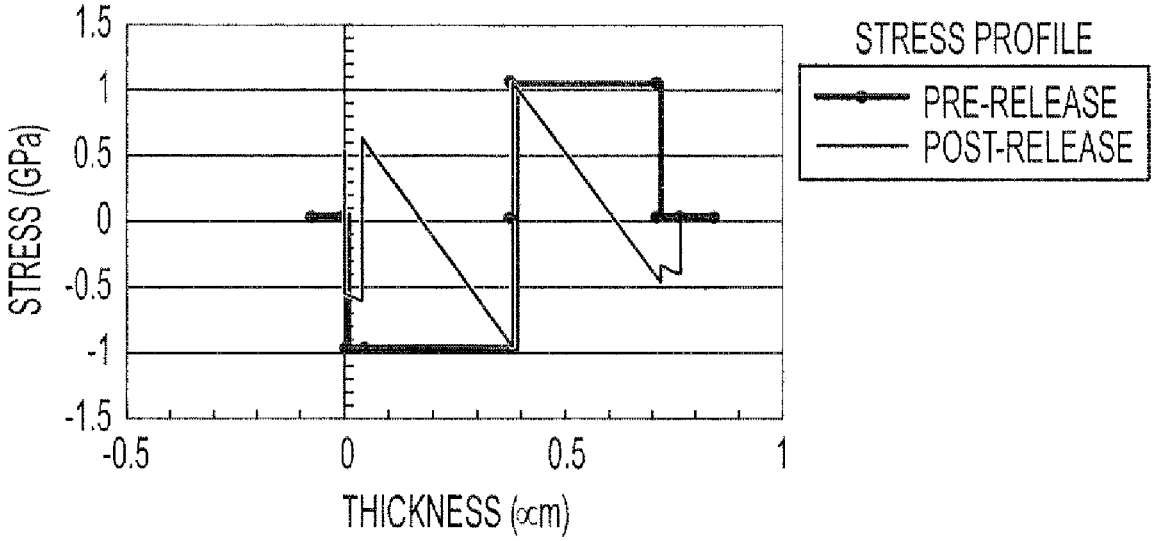
FIG. 7 is a graph showing a stress profile through a thickness of another bi-layer spring contact utilizing a cladding before and after release of the spring contact.

There are additional ways to provide a compressive outer surface to a spring contact. One example is to produce a spring with a cladding having an appropriate modulus of elasticity and appropriately engineered stress. FIG. 7 is a graph showing the stress profile though a thickness of another bi-layer spring contact utilizing a cladding.

The upper and lower spring metal layers 22 and 24 may be formed with equal thicknesses leaving the neutral axis at the halfway point of the thickness and resulting in zero net pre-release stress. The lower spring material layer is formed and a compressive stress is introduced to that layer. The upper spring material layer is then formed and a tensile stress is introduced to that layer. The spring is released and a compressive cladding layer is deposited on the spring resulting in a lower outer cladding layer 23 and an upper outer cladding layer 25.

A cladding layer of low modulus with compressive stress on the unreleased bottom of the spring will relax less that its adjacent higher modulus spring material. The effect is that the low modulus cladding material remains compressive post-release. Further, if the cladding material is ductile, it can suppress cracking by blunting the radius of any cracks that attempt to propagate.

Figure 8:
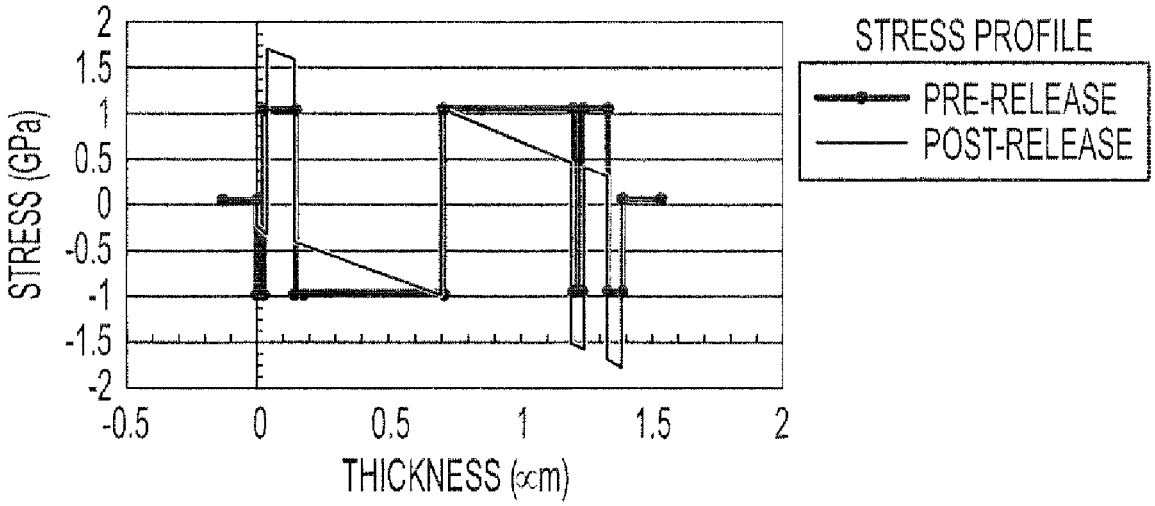
FIG. 8 is a graph showing a stress profile through a thickness of another bi-layer spring contact utilizing a multi-layer cladding before and after release of the spring contact.

FIG. 8 is a graph showing the stress profile through thickness of another bi-layer spring contact utilizing a multi-layer cladding. The cladding layers are deposited with alternating compressive and tensile stresses such that the stack of cladding layers on the bottom and/or top surface each have a net stress of zero. The stack may be made by simply applying an intermediate tensile layer of cladding material prior to applying the outer compressive cladding layer. Multiple layers of cladding may also be used. This procedure may be useful in the manufacturing of high-cost-per-chip applications such as scanning probes where the complexity of the overall process does not matter very much.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A method of manufacturing a spring comprising:

depositing a lower layer of spring metal;

introducing a compressive stress into the lower layer of spring metal;

depositing an upper layer of spring metal; and introducing a tensile stress into the upper layer of spring metal, wherein the lower layer has a thickness less than or equal to one half of a thickness of the upper layer.

2. The method of claim 1, wherein introducing a compressive stress into the lower layer of spring material and introducing a tensile stress into the upper layer of spring material includes introducing a net stress of zero into the spring.

3. The method of claim 1, wherein introducing a compressive stress into the lower layer of spring material includes introducing a compressive stress having a magnitude at least three times larger than the tensile stress introduced into the upper layer of spring metal.

4. The method of claim 1, further comprising depositing intermediate layers of spring metal after depositing the lower layer of spring metal and before depositing the upper layer of spring metal; and introducing a compressive or tensile stress to each of the intermediate layers of spring metal.

5. The method of claim 4, wherein introducing a compressive or tensile stress to each of the intermediate layers of spring metal includes introducing a compressive stress less than the magnitude of the compressive stress in the lower layer of spring metal or introducing a tensile stress less than the magnitude of tensile stress in the upper layer of spring metal.

* * * * *